United States Patent [19]

Plummer, III

[11] 4,409,427

[45] Oct. 11, 1983

[54] RADIO FREQUENCY SHIELDING JACKET FOR MULTIPLE RIBBON CABLES

[76] Inventor: Walter A. Plummer, III, 14831 Foxcroft Rd., Tustin, Calif. 92680

[21] Appl. No.: 325,725

[22] Filed: Nov. 30, 1981

[51] Int. Cl.[3] ..... H01B 7/34

[52] U.S. Cl. ..... 174/36; 174/DIG. 11

[58] Field of Search ..... 174/DIG. 11, 35 R, 35 MS, 174/36

[56] References Cited

U.S. PATENT DOCUMENTS

| | | | |
|---|---|---|---|
| 2,810,944 | 10/1957 | Sander | 24/201 |
| 2,960,561 | 11/1960 | Plummer | 174/36 |
| 3,032,604 | 5/1962 | Timmons | 174/15 |
| 3,089,915 | 5/1963 | Plummer | 174/36 |
| 3,467,761 | 9/1969 | Plummer | 174/680 |
| 3,582,532 | 6/1971 | Plummer | 174/DIG. 11 |
| 3,612,743 | 10/1971 | Angele | 174/106 R |
| 3,624,267 | 11/1971 | Plummer | 174/36 |
| 3,757,029 | 9/1973 | Marshall | 174/117 FF |

FOREIGN PATENT DOCUMENTS

| | | | |
|---|---|---|---|
| 1509648 | 1/1968 | France | 174/DIG. 11 |

*Primary Examiner*—G. P. Tolin

*Attorney, Agent, or Firm*—Sellers and Brace

[57] ABSTRACT

Protective jacketing and electrostatic and radio frequency shielding is provided for multiple ribbon cables comprising inner and outer subassemblies each having flexible conductive shields secured together in electrical contact with one another and cooperating to provide a gapless shield embracing the cables. The inner subassembly is pleated longitudinally to form a separate shielded cell for each cable with the open edge of each cell embraced by the conductive shielding of the outer subassembly. The outer subassembly being held releasably closed as by a separable longitudinal seam. Conductive braiding and foil is held assembled to and in contact with the shielding layer of the inner subassembly and is maintained in contact with the shielding layer of the outer subassembly when the separable seam of the jacketing is closed.

5 Claims, 5 Drawing Figures

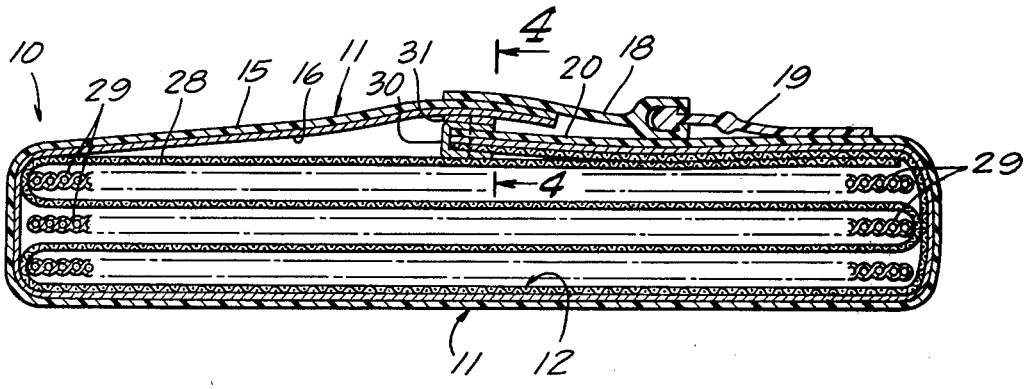
FIG. 3.
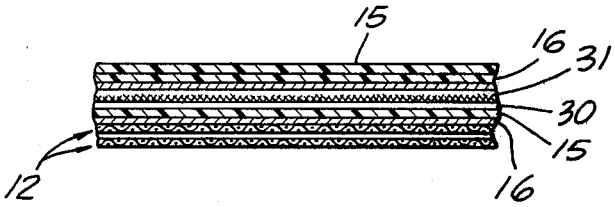
FIG. 4.
FIG. 5.
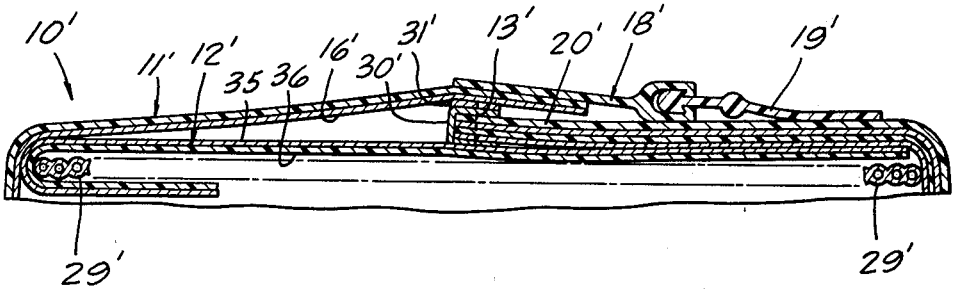

RADIO FREQUENCY SHIELDING JACKET FOR MULTIPLE RIBBON CABLES

This invention relates to electrical shielding for cabling, and more particularly to a unique unitary flexible jacket assembly specially designed for use in shielding multiple ribbon cables from electrostatic and radio frequency interference.

BACKGROUND OF THE INVENTION

Heretofore various proposals have been made for embracing conductors and cabling with conductive shielding expedients to safeguard the conductors from contamination by flux and electrostatic fields and by radio frequency interference. Certain shielding expedients utilize shields permanently assembled about the conductors and cabling but these are subject to the serious disadvantage of precluding access to the interior of the cabling for servicing operations or to add or remove conductors. To meet the latter requirements there have been numerous proposals involving the use of shielding jackets equipped with fastening means for holding the jackets snugly in place yet permitting access to the interior of the jacket when desired. Examples of the latter type of jacketing are to be found in Plummer U.S. Pat. Nos. 2,960,561; 3,089,915; 3,467,761; and 3,582,532. The last issued one of these patents is specially constructed to accommodate multiple ribbon cables and to shield these as a group from the electrostatic and radio frequency interference external to the shield. However, this construction lacks any provision for shielding individual cables from one another within the same jacket. Furthermore, the shielding therein proposed comprises a single strip of shielding which must be unwrapped to provide access to the cables.

SUMMARY OF THE INVENTION

This invention provides a unitary shielding jacket assembly especially designed to enclose each of several ribbon cables in a separate shielding cell each of which is open along one lateral edge providing ready access thereto for the insertion or removal of a ribbon cable. These storage cells are conveniently provided by an accordian pleated inner sub-assembly of flexible material which includes or is formed by conductive shielding. The pleated inner sub-assembly is permanently secured to the interior of a seam-equipped laminated outer shielding jacket the outer layer of which comprises pliant non-conductive material equipped with a separable interlocking seam. These two sub-assemblies are superimposed and secured together along a pair of their adjacent lateral edges which are embraced by a conductive strip and including conductive braid positioned to be pressed against the shield of the outer subassembly when its seam is closed. This seam is readily opened upon need thereby providing unobstructed access to ribbon cable storage cells.

Accordingly, it is a primary object of the invention to provide a novel jacket designed for assembly about a plurality of ribbon cables and having provision for shielding each thereof from one another and from electrostatic and radio frequency interference.

Another object of the invention is the provision of a unitary jacket having an accordian-pleated inner shield subassembly cooperating with an outer shield subassembly equipped with a separable seam to snugly enclose and shield each of a plurality of ribbon cables from electrostatic and radio frequency interference.

These and other more specific objects will appear upon reading the following specification and claims and upon considering in connection therewith the attached drawing to which they relate.

Referring now to the drawing in which a preferred embodiment of the invention is illustrated:

FIG. 3 is a cross sectional view on an enlarged scale taken along line 3—3 on FIG. 1;

FIG. 4 is a fragmentary cross sectional view taken along line 4—4 on FIG. 3; and FIG. 5 is a fragmentary cross sectional view of a second embodiment of the invention having a laminated shielding sub-assembly.

Figure 1:
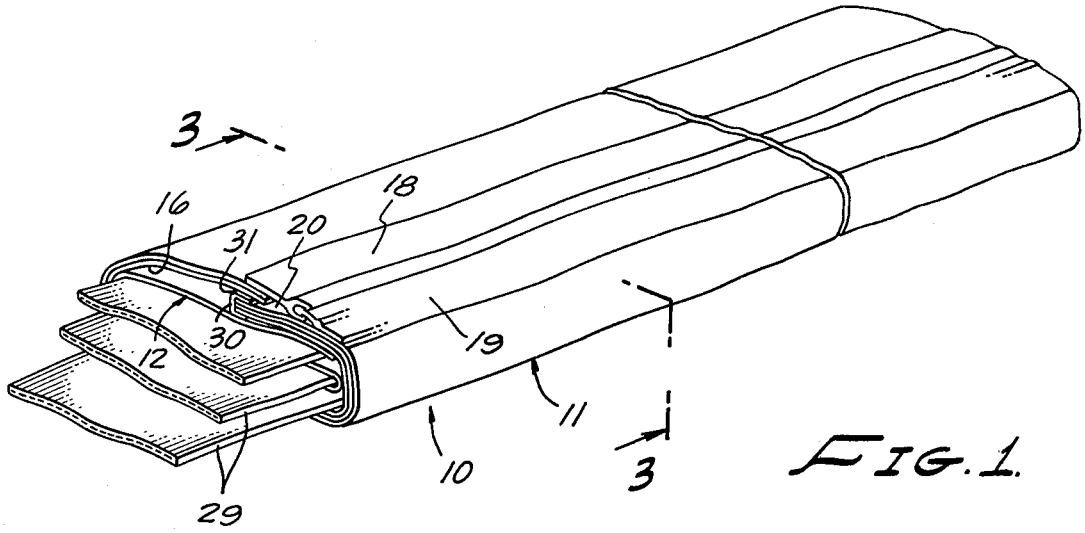
FIG. 1 is a perspective view of an illustrated embodiment of the invention shielding jacket fully assembled about a plurality of ribbon cables.
Figure 2:
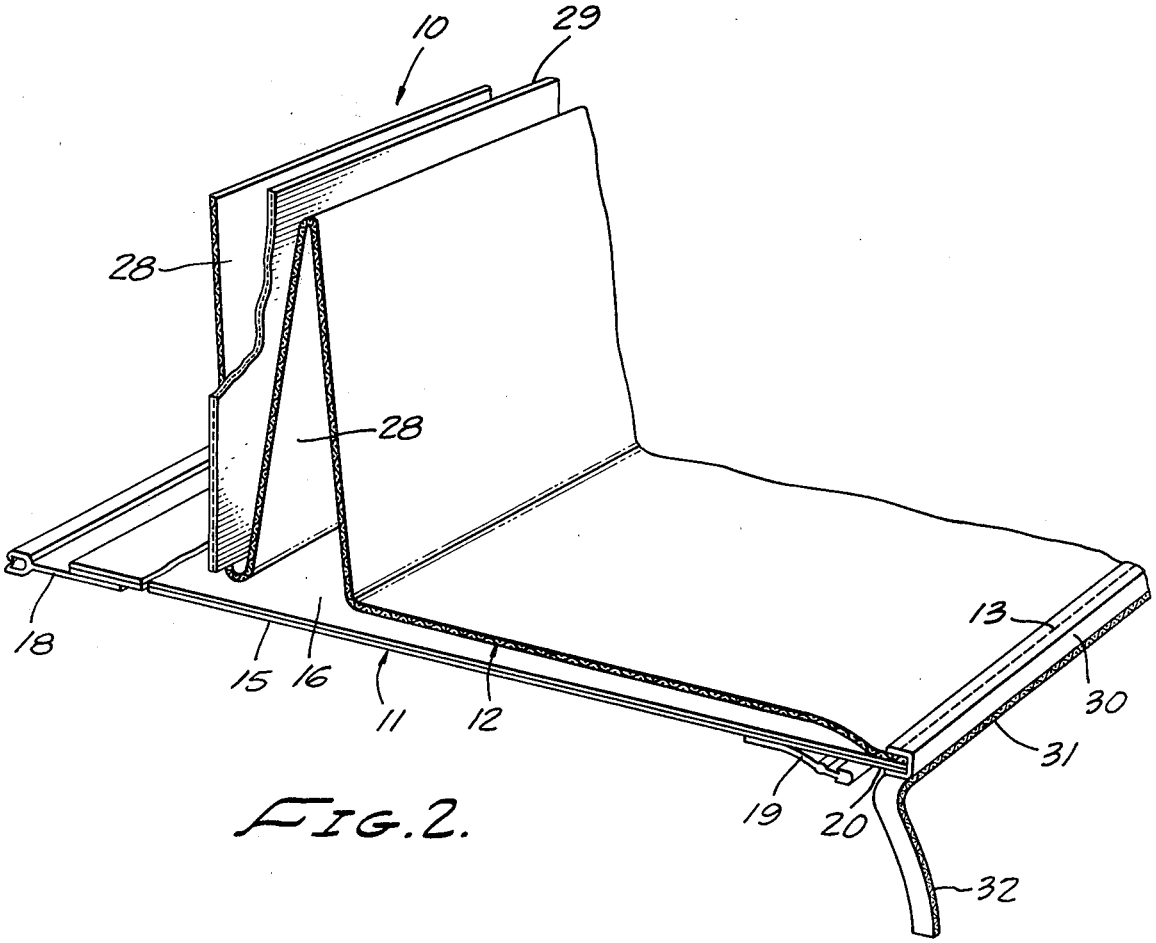
FIG. 2 is a fragmentary perspective view of the jacket shown in FIG. 1 in open position and with the accordian pleated inner shield subassembly partially expanded.

Referring more particularly to FIGS. 1 and 2, there is shown an illustrative embodiment of the invention unitary electrostatic and radio frequency interference shielding jacket designated generally 10. This jacket includes an outer subassembly 11 and an accordian pleated inner subassembly or unit 12 suitably secured together along one of their adjacent lateral edges as by stitching 13.

The outer subassembly 11 has a supple laminated main body comprising an outer layer 15 of impervious non-conductive material such as polyvinylchloride or the like, laminated to a conductive inner layer 16, such as aluminum foil. This outer unit has a width sufficient to embrace the desired number of ribbon cables. The opposite lateral portions of the outer subassembly 11 are provided with suitable readily separated fastener means, such as the extruded interlocking seam tapes 18 and 19 well known to persons skilled in this art and described in detail in the patent to Sander U.S. Pat. No. 2,810,944 granted Oct. 29, 1957. The male seam member 19 is preferably secured to the main body of the jacket inwardly of a guard flap 20 extending lengthwise of the main body and underlying both of the seam components 18 and 19 when assembled to one another as shown in FIGS. 1 and 3. In consequence and in the closed condition of the seam, it will be observed that the conductive shielding layer 16 completely embraces the inner shielding 12 as shown in FIGS. 1 and 2.

The illustrative embodiment of the inner shielding unit 12 shown in FIGS. 1 and 2 comprises nylon fabric or mesh coated with silver readily folded into accordian pleats as shown. Each pleat cooperates with adjacent pleats to form a plurality of shielded storage cells 28 for a respective length of ribbon cable of a type well known to those skilled in the cable art. The nylon filament possesses great strength and a support for the highly-conductive and highly efficient shielding silver coating. As is clearly shown in FIG. 2, the inner unit 12 is pleated lengthwise of the unitary jacket with the width of each pleat corresponding generally to the interior width of the outer jacket when closed about the several ribbon cables 29.

As viewed in FIG. 2, the right hand lateral edge of shielding unit is placed against the inner surface of guard flap 20 in alignment with its lateral edge. These edges are then embraced by a U-shaped strip 30 of conductive material such as aluminum foil. Tinned copper braid 31 is then placed against the exterior leg of the foil strip 30 and the elements 11, 12, 30 and 31 are secured together by one or more rows of strong stitching 13. The foil strip 30 provides an excellent conductive path between the two shielding members 12 and 16 and the heavy duty copper braid 31 both ends of which preferably extend beyond the ends of jacketing 10 to facilitate connection to grounding facilities or to another length of shielded jacketing 10.

The mode of utilizing the described shielded jacketing 10 will be readily apparent from the foregoing description of its structural details. The jacketing is opened and the accordian pleated inner unit 12 is expanded as in the manner shown in FIG. 2. Individual lengths of ribbon cable 29 are then inserted in one or more of the cells 28, successive ones of which open laterally along the opposite sides of the pleated unit 12.

Unit 12 with its complement of ribbon cables 29 is then collapsed and flattened, and the opposite lateral edges of the outer subassembly 11 are folded about the inner unit. Seam tapes 18 and 19 are then closed by a suitable tool well known to those skilled in this art. The protruding terminal end 32 of the conductive braid 31 is then connected to a ground cable or to the terminal end of an adjacent section of the shield jacket 10. As is made clear by FIGS. 1 and 3, guard flap 20 underlies and fully bridges the unshielded seam members 18 and 19 and the conductive braid 31 is held in firm contact with the adjacent lateral edge portion of the conductive foil 16 laminated to the inner side of the outer unit 11. This provides a gapless tubular shield for all of the cables 29 which are further shielded from one another by the accordian pleated unit 12.

Should the user have need for gaining access to any one of the cables 29, the seam 18, 19 is opened and folded outwardly to expose the open sides of each of the cable storage cells 28. A service operation is then carried on with any selected one or more of the cables without need for disturbing the others following which the outer jacket is reclosed in the same manner described above.

The second illustrative embodiment of the invention shown in FIG. 5 differs from the first described embodiment only in having a laminated shielded inner subassembly. Accordingly, the same reference characters have been utilized to designate the same components and are distinguished by the addition of a prime.

The accordian pleated inner shielding unit 12' is a flexible laminated member formed of conductive metal foil 35 bonded non-conductive material such as plastic 36. The latter serves several functions including protection against rupture or damage to the foil shielding, additional insulation for the ribbon cables and, importantly, greater separation between the conductors of adjacent cables 29' thereby minimizing the possibility of electrostatic and the like interference. In all other respects, the construction, operation and mode of use is the same as that described above for FIGS. 1–4.

While the particular radio frequency shielding jacket for multiple ribbon cables herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A unitary tubular jacket for shielding a plurality of ribbon cables from electrical interference comprising:

inner and outer shielding subassemblies the inner one of which comprises a flexible strip of flexible conductive material foldable into a plurality of accordian pleats forming storage cells for a respective ribbon cable and the outer one of which subassemblies has one lateral edge secured to one lateral edge of said inner subassembly;

a pair of separable interlocking seam members secured to the lateral edge portions of said outer subassembly in a manner providing a guard flap sufficiently wide to bridge and underlie said seam members when interlocked to one another;

said outer subassembly comprising an outer layer of flexible non-conductive material secured to an inner layer of conductive material; and means, including conductive braids electrically connected to said conductive inner subassembly and secured to the outer side of said guard flap in position to lie in contact with the conductive layer of said outer subassembly when said seam members are interlocked.

2. A tubular shielding jacket as defined in claim 1 characterized in the provision of a U-shaped strip of conductive foil attached to and embracing said secured together lateral edges of said inner and outer subassemblies and providing a conductive path between said braid and the conductive portions of said inner and outer subassemblies.

3. A tubular shielding jacket as defined in claim 1 characterized in that said conductive material of said inner subassembly is laminated to flexible non-conductive material substantially throughout the length and breadth thereof.

4. A tubular shielding jacket as defined in claim 1 characterized in that said inner subassembly comprises non-conductive fabric coated with conductive material.

5. A tubular shielding jacket as defined in claim 1 characterized in that said inner subassembly comprises plastic fabric coated with silver.

* * * * *